United States Patent [19]

Fuchs, Jr.

[11] 4,037,454

[45] July 26, 1977

[54] TUBE FORMING

[75] Inventor: Francis Joseph Fuchs, Jr., Princeton Junction, N.J.

[73] Assignee: Western Electric Company, Inc., New York, N.Y.

[21] Appl. No.: 694,499

[22] Filed: June 10, 1976

[51] Int. Cl.[2] ..... B21C 25/02

[52] U.S. Cl. ..... 72/264; 72/269

[58] Field of Search ..... 72/264, 269; 164/84, 164/85; 228/151

[56] References Cited

U.S. PATENT DOCUMENTS

| | | | |
|---|---|---|---|
| 2,698,684 | 1/1955 | Guiney et al. | 72/269 |
| 2,723,028 | 11/1955 | Carter | 72/269 |

FOREIGN PATENT DOCUMENTS

| | | | |
|---|---|---|---|
| 146 | 5/1969 | Japan | 164/85 |

*Primary Examiner*—Lowell A. Larson

*Attorney, Agent, or Firm*—A. S. Rosen; M. Y. Epstein

[57] ABSTRACT

An unpierced metallic billet of relatively large diameter is subjected to three successive stages of deformation so as to form a metallic tube of relatively small outer diameter. In a first stage, the billet is given a generally "C"-shaped cross-sectional configuration. In a second stage, the diameter of the generally "C"-shaped cross-section is reduced and, simultaneously, the ends of the generally "C"-shaped cross-section are guided toward and then into contact with one another. In a third stage, the contacting ends are welded together. The three stages of deformation take place in a single die through which the billet is continuously hydrostatically extruded, the hydrostatic extrusion process utilizing a deoxidizing, lubricating, shear transmitting medium in displacing the billet through the die.

16 Claims, 11 Drawing Figures

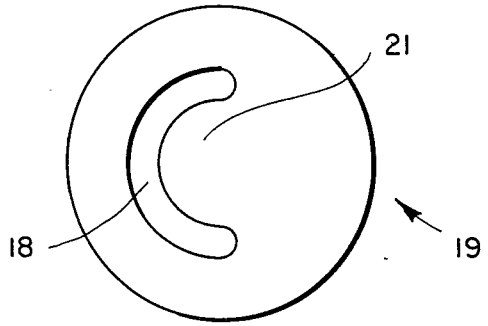
FIG. 2
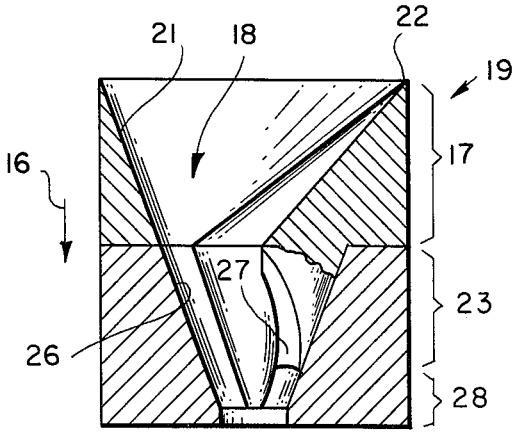
FIG. 3
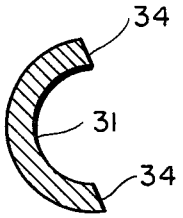
FIG. 4A
FIG. 4B
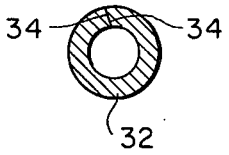
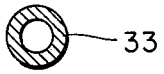
FIG. 4C
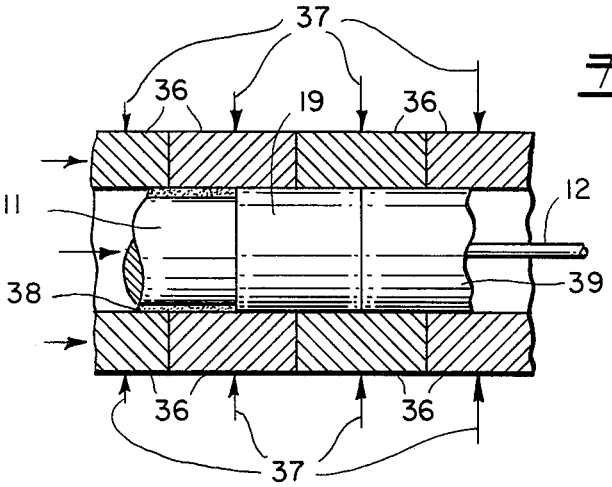
FIG. 5

TUBE FORMING

BACKGROUND OF THE INVENTION

1. Field of the Invention

This invention relates to methods and apparatus for forming a metallic tube and, more particularly, to methods and apparatus for forming a metallic tube from an unpierced metallic billet.

2. Description of the Prior Art

In the art of forming metallic tubes, it is known to employ a pierced metallic billet, i.e., a longitudinally extending metallic billet which is initially drilled to provide an aperture extending along its longitudinal axis. The pierced billet is extruded longitudinally through an aperture in a die, with a mandrel positioned within the hollow center of the billet and extending along the axis of the billet into the die aperture from a location upstream of the die aperture. Subsequent drawing operations may then be utilized to reduce the tubing to a desired finished size. While such a technique is well adapted to form tubing form tubing of good quality, the initial drilling operation is generally quite costly, in terms of both time and material loss, with any subsequent drawing operations involving additional costs. Moreover, the drilling operation can be performed accurately only on relatively short billets, eliminating any possibility for the use of pierced billets in continuous extrusion machines.

It is also known to form tubes of relatively soft metallic materials, e.g., aluminum, by extruding unpierced billets of such materials through "spider dies", i.e., dies which have core mandrels attached to the die sides by means of struts. The use of such spider dies with harder metallic materials is not practicable, due to the presence of very significant stresses and wear forces on the die struts as the billet material parts into several steams in advancing past the struts, prior to rewelding downstream.

A technique of extruding an unpierced metallic billet so as to form tubing of circular cross-section, which technique avoids the use of a spider die, is found in U.S. Pat. No. 1,847,365 to C. D. Skinner. The Skinner patent discloses three stages of billet deformation. In a first stage, a heated metallic billet is forced longitudinally through a generally C-shaped passageway, thereby imparting a generally C-shaped configuration to the cross-section of the billet in a plane perpendicular to the longitudinal direction of extrusion. In a second stage of deformation, the billet material traverses a relatively large diameter, annular zone, i.e., an annular zone having an outer diameter equal to that of the generally C-shaped passageway of the first stage of deformation, until an abrupt contact with a radially extending wall which includes a relatively small diameter, annular die aperture, i.e., an annular die aperture with an outer diameter which is substantially smaller than the outer diameter of the generally C-shaped passageway of the first stage of deformation. A terminal member projects downstream through both the annular zone and the annular die aperture from the upstream region of the generally C-shaped passageway, providing inner boundaries to the annular zone and annular die aperture. During the second stage of deformation, the billet material is so reshaped as to produce a continuously annular body of metal, with a relatively large outer diameter, equal to that of the generally C-shaped cross-section formed during the second stage of deformation, extending for some distance upstream of the annular die aperture. Then, in a third stage of deformation, the annular body of metal is extruded longitudinally through the annular die aperture, forming a length of tubing with a relatively small outer diameter, equal to that of the annular die aperture.

The Skinner patent does not identify the material of the billet, other than specifying that it is a metal. The billet material is apparently relatively soft, however, due to its composition and/or to the use of a heated extrusion cylinder into which the billet is placed prior to the start of the first stage of deformation. The softness of the billet material may be appreciated by virtue of the presence of the previously mentioned, abrupt contacting of the billet material with the radially extending wall which includes the relatively annular die aperture, whereupon the material of the billet first fills up a substantial volume within the annular zone adjacent to the wall, attaining an annular shape of relatively large diameter, and is thereafter extruded into tubing of much smaller diameter in a single stage of extrusion.

A technique generally similar to that of the Skinner patent is demonstrated in U.S. Pat. No. 2,698,684 to K. B. Guiney and C. R. Anderson. The Guiney et al. patent discloses a process for forming tubing of various non-circular, cross-sectional configurations, which appears to involve essentially the three stages of deformation of the Skinner patent, modified somewhat for the formation of non-circular shapes. The Guiney et al. technique is disclosed as having been performed successfully only on aluminum and its alloys, although the patent indicates a belief that this technique may have wider applicability.

While the use of spider dies and the techniques of the aforementioned Skinner and Guiney et al. patents may be effective to produce good tubing from unpierced billets composed of relatively soft or heat-softened metals, such as aluminum, it would clearly be advantageous to provide methods and apparatus for forming high quality tubing, preferably continuously, from an unpierced billet composed of any relatively soft or relatively hard metal, while avoiding any necessity for heating the billet prior to the forming operation.

SUMMARY OF THE INVENTION

The invention contemplates the formation of metallic tubing of circular or other cross-section from an unpierced metallic billet by subjecting the billet to three successive stages of deformation. In a first stage, the billet is extruded along a longitudinal direction through a first dies aperture region so configured as to provide the billet with a generally C-shaped cross-section perpendicular to the longitudinal direction. Then, in a second stage of deformation, the billet is further extruded through a second die aperture region so configured as to reduce the diameter of the generally C-shaped cross-section. At the same time, both ends of the generally C-shaped cross-section are guided continuously toward and then into contact with one another within the second die aperture region so as to form a tubular shape. Finally, in a third stage of deformation, the contacting ends are welded together, e.g., by still further extruding the billet through a third die aperture region so configured as to reduce the outer diameter of the tubular shaped billet to an extend sufficient to cause such welding, thereby forming a tube.

Preferably, the first stage of deformation also involves a reduction in the diameter of the generally C-shaped cross-section undergoing extrusion in the first die aperture region, prior to the entry of the billet into the second die aperture region, whereupon the guidance of the ends of the generally C-shaped cross-section toward and into contact with one another commences with a further reduction in the diameter of the generally C-shaped cross-section during the second stage of deformation.

The three die aperture regions are preferably longitudinally aligned regions within a single die. The unpierced metallic billet may be advanced through the three die aperture regions of the die in succession by a continuous hydrostatic extrusion mechanism, such as that taught in my copending application, Ser. No. 612,875, filed Sept. 12, 1975. The continuous hydrostatic extrusion mechanism may utilize a deoxidizing, lubricating, shear-transmitting medium for advancing the billet toward the die or assisting in such advance, for lubricating the die to facilitate passage of the billet therethrough, and for preventing oxidation of the ends of the generally C-shaped cross-section of the billet such as might interfere with welding during the third stage of deformation. In addition, welding may be further facilitated by so extruding the billet, during the first stage of deformation, as to provide flat surfaces at both ends of the generally C-shaped cross-section, with the flat surfaces so oriented as to meet one another, during the second stage of deformation, in a flat, abutting relationship, extending along a direction transverse to a plane passing diametrically through the tubular shape which is formed during the second stage of deformation.

By employing three stages of deformation as just set forth, in conjunction with an appropriate continuous hydrostatic extrusion mechanism, it is expected that high quality tubing may be formed continuously from pieced billets composed of either relatively soft metals, such as aluminum, or relatively hard metals, such as copper. Moreover, with a sufficient reduction in the outer diameter of tubular shaped billet during the third stage of deformation, the avoidance of any visible seam markings at the location of the weld may be anticipated.

BRIEF DESCRIPTION OF THE DRAWING

FIGS. 2 and 3 are, respectively, an end view and a longitudinal cross-sectional view of a die suitable for deforming the unpierced metallic billet of FIG. 1A to form the metallic tube of FIG. 1D;

FIGS. 4A, 4B, and 4C are successive cross-sectional configurations of the unpierced metallic billet of FIG. 1A undergoing three stages of deformation in accordance with an alternative embodiment of the invention, FIGS. 4A, 4B and 4C corresponding, respectively, to the cross-sectional configurations of FIGS. 1B, 1C and 1D; and FIG. 5 is a longitudinal view, partly in section, of portions of apparatus which may be employed to advance the unpierced metallic billet of FIG. 1A against and through a suitable die, such as the die of FIGS. 2 and 3, in order to form the metallic tube of FIG. 1D.

DETAILED DESCRIPTION

Figure 1:
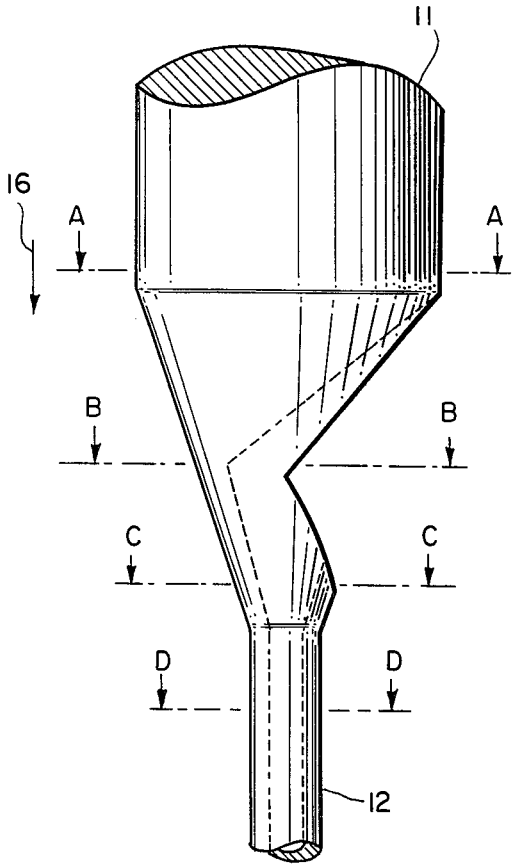
FIG. 1 of the drawing is a longitudinal view illustrating a portion of an unpierced metallic billet being subjected to three successive stages of deformation, in accordance with the principles of the invention, so as to form a metallic tube.
Figure 1A:
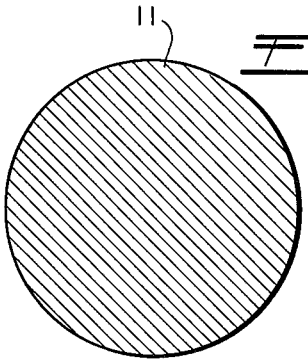
FIGS. 1A, 1B, 1C, and 1D are sections of the billet undergoing deformation in FIG. 1, taken in the respective radial planes A—A, B—B, C—C, and D—D shown in FIG. 1, and representing, respectively, the unpierced billet prior to deformation, the cross-sectional configuration of the billet at the end of a first stage of deformation, the cross-sectional configuration of the billet at the end of a second stage of deformation, and the final cross-sectional configuration of the completed tube after all three stages of deformation have been performed.
Figure 1B:
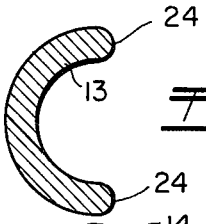
Figure 1C:
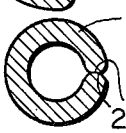
Figure 1D:
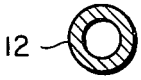

Referring initially to FIGS. 1 and 1A through 1D of the drawing, it is desired that an unpierced metallic billet 11, with a relatively large diameter, circular cross-section (FIG. 1A), be reshaped into the form of a metallic tube 12 with an annular cross-section of relatively small outer diameter (FIG. 1D). Such transformation may be effected by subjecting the billet 11 to three successive stages of deformation, the shape of the cross-section of the billet 11 after each of the three stages of deformation corresponding to the configurations 13, 14 and 12 depicted, respectively, in FIGS. 1B, 1C and 1D. FIG. 1 illustrates the billet 11 with different longitudinal portions thereof undergoing each of the stages of deformation, such deformation taking place as the billet 11 is displaced in a longitudinal direction, indicated by the arrow 16 in FIG. 1. Thus, FIG. 1 represents a continuous pattern of the changes in shape of the billet 11 during the entire process of transformation into the tube 12.

A first stage of deformation of the billet 11 takes place as the material of the billet 11 is displaced along the longitudinal direction of arrow 16 between the locations of radial planes A—A and B—B in FIG. 1 of the drawing. In the first stage of deformation, the initially round billet 11 is extruded through a first die aperture region, e.g., the region 17 of an aperture 18 through a die 19 which is depicted in FIGS. 2 and 3. The first die aperture region 17 preferably comprises a tapered entrance zone 21 (FIG. 3) extending radially and longitudinally inwardly into the interior of the die 19 from a forward edge 22 of the die 19. The first due aperture region 17 is so configured as to provide the billet 11 with a generally C-shaped cross-section, i.e., the cross-section 13 of FIG. 1B, perpendicular to the longitudinal direction, i.e., in the radial plane B—B of FIG. 1. The diameter of the generally C-shaped cross-section 13 undergoes a continuous reduction within the first die aperture region 17 as and after the billet 11 is deformed into the generally C-shaped configuration 13, due to the inward taper of the entrance zone 21 (FIG. 3).

Thereafter, in a second stage of deformation, the deformed billet 11 with the generally C-shaped cross-sectional configuration 13 is further extruded through a second die aperture region, e.g., the region 23 of die aperture 18 (FIG. 3), as the deformed billet 11 is further displaced along the longitudinal direction of the arrow 16 is between the locations of radial planes B—B and C—C of FIG. 1. The second die aperture region 23 is so configured as to reduce further the diameter of the generally C-shaped cross-section 13, while simultaneously guiding both ends 24 of the generally C-shaped cross-section 13 of FIG. 1B continuously toward and then into contact with one another within the second die aperture region 23, so as to form the tubular shape 14 shown in FIG. 1C. A radially and longitudinally inwardly tapering wall surface 26 (FIG. 3) and a pair of appropriately disposed guiding surfaces 27 (only one shown) form portions of the die 19 at the second die aperture region 23. The surfaces 26 and 27 cooperate to effect the respective diameter reducing and end guiding operations on the generally C-shaped cross-section 13 during the passage of the deformed billet 11 through the second die aperture region 23.

Finally, the two contacting ends 24 of the tubular shape 14 of FIG. 1C are welded together, preferably by still further extruding the deformed billet 11 through a third die aperture region, e.g., the region 28 of die aperture 18 (FIG. 3), as the deformed billet 11 is still further displaced along the longitudinal direction of the arrow 16 between the locations of radial planes C—C and D—D of FIG. 1. The third die aperture region 28 is so configured as to reduce the outer diameter of the tubular shaped billet of FIG. 1C to an extent sufficient to cause the welding together of the contacting ends 24, preferably without leaving any visible seam markings, so as to form the tube 12 of relatively small outer diameter depicted in FIG. 1D of the drawing. The reduction in the outer diameter of the tubular shape 14 of the FIG. 1C cross-section is effected by a continuation of the tapered surface 26 of the second die aperture region 23 which extends into the third die aperture region 28.

An alternative embodiment of the technique of my invention is illustrated in FIGS. 4A, 4B and 4C of the drawing, showing respective cross-sectional configurations 31, 32 and 33 provided to the billet 11 after each of three stages of deformation corresponding to the three stages of deformation of the previously described embodiment. In particular, the cross-sections 31, 32 and 33 correspond, respectively, to the cross-sections 13, 14 and 12 of FIGS. 1B, 1C and 1D. The cross-section 31 formed during the first stage of deformation of the alternative embodiment differs from the previously described cross-section 13 only in that the ends 34 of the generally C-shaped of cross-section 31 constitute flat surfaces. The flat surfaces at the ends 34 are so oriented as to meet one another, after the second stage of deformation (FIG. 4B), in a flat, abutting relationship, extending along a direction transverse to a plane passing diametrically through the tubular shape 32 formed during the second stage of deformation. The transverse direction, along which the flat, abutting surfaces 34 extend, serves to enhance the welding effect during the third stage of deformation by better taking advantage of the radially directed forces which are involved in the reduction of the outer diameter of the tubular shape 32 to produce the finished tube 33. The three successive stages of deformation which form the successive cross-sectional configurations 31, 32 and 33 may be effected by extrusion of the billet 10 through three die aperture regions within a die substantially similar to the die 19 of FIGS. 2 and 3, differing only in the shapes of the surfaces utilized to form and guide the ends 34 of the generally C-shaped cross-section 31.

Turning now to FIG. 5 of the drawing, there are illustrated pertinent portions of a preferred apparatus for utilizing an appropriate die, constructed in accordance with the principles of the invention, such as the die 19, to form a metallic tube of relatively small outer diameter, such as the tube 12, from an unpierced metallic billet preferably having a circular cross-section of relatively large diameter, such as the billet 11. This apparatus is more fully described in my copending application, Ser. No. 612,875, filed Sept. 12, 1975. The apparatus includes a number of gripping element sectors 36 which are advanced from left to right as illustrated in FIG. 5. As the sectors 36 advance toward the right, they are subjected to a continually increasing compressive pressure, as indicated by arrows 37 which increase in size from left to right.

An unpierced metallic billet, for example, the billet 11, has its outer periphery coated with a deoxidizing, lubricating, shear transmitting medium 38, e.g., polyethylene wax. Shear stresses transmitted through the medium 38 serve to advance the billet 11 from left to right in FIG. 5 with the advancing sectors 36. At the same time, compressive stresses of continually increasing magnitude are also imposed upon the advancing billet 11, thereby rendering the billet 11 considerably more ductile and more suited to extrusion. The medium 38 in addition to its acting as a shear transmitting medium, serves both to prevent oxidation at the ends 24 of the generally C-shaped cross-section 13 of the billet 11, such as might interfere with welding during the third stage of deformation, and to lubricate the aperture 18 in the die 19 through which the billet 11 is extruded, thereby reducing the axial forces required for extrusion. Such extrusion takes place, with the billet 11 rendered suitably ductile by the compressive pressures exerted upon it, as the billet 11 is forced against die 19 and through its aperture 18, by shear forces in the medium 38, so as to form the tube 12. Die 19, which is carried on a suitable die stem 39, may, of course, be replaced by any other suitable die structure constructed in accordance with the principles of the invention, e.g., a die structure suited to forming the tube 33 by the alternative embodiment depicted in FIGS. 4A, 4B and 4C of the drawing.

It is to be understood that the described methods and apparatus are simply illustrative of preferred embodiments of the invention. It should be clear that various other tubular shapes (e.g, ellipitical, rectangular, square) could be formed by slightly varied embodiments of the technique disclosed, and that unpierced metallic billets of other than circular cross-section might be employed to produce either the depicted tubular shape or such various other tubular shapes. Moreover, alternative continuous hydrostatic extrusion mechanisms, such as that disclosed in my copending application, Ser. No. 664,611, filed Mar. 8, 1976, might readily be substituted for the mechanism illustrated in FIG. 5 of the drawing. Many other modifications may be made in accordance with the principles of the invention.

What is claimed is:

1. A method of forming a metallic tube from an unpierced metallic billet, which method comprises the steps of:

a. extruding the billet along a longitudinal direction through a first die aperture region so configured as to provide the billet with a generally C-shaped cross-section perpendicular to said longitudinal direction; then b. further extruding the billet through a second die aperture region so configured as to reduce the diameter of the generally C-shaped cross-section; while simultaneously c. guiding both ends of the generally C-shaped cross-section continuously toward and then into contact with one another within said second die aperture region so as to form a tubular shape; and then d. welding said contacting ends together so as to form said metallic tube.

2. A method as set forth in claim 1, wherein step (a) further comprises:

e. reducing the diameter of the generally C-shaped cross-section during the extrusion of the billet through said first die aperture region.

3. A method as set forth in claim 2, wherein step (d) comprises:

f. still further extruding the billet through a third die aperture region so configured as to reduce the outer diameter of the tubular shaped billet to an extent sufficient to cause the welding together of said contacting ends.

4. A method as set forth in claim 3, further comprising:

g. initially providing a deoxidizing lubricant coating on the billet prior to the performance of step (a).

5. A method as set forth in claim 3, wherein steps (a), (b), (c), (d), (e) and (f) comprise:

g. extruding the billet along the longitudinal direction through a single die.

6. A method as set forth in claim 1, wherein steps (a) and (c) further comprise, respectively:

e. so extruding the billet as to provide flat surfaces at both ends of the generally C-shaped cross-section, said flat surfaces being so oriented as to meet one another, upon the performance of said step (c), in a flat, abutting relationship, extending along a direction transverse to a plane passing diametrically through said tubular shape; and then f. so guiding the billet ends as to bring said flat surfaces into said flat, abutting relationship.

7. A method as set forth in claim 6, wherein step (d) comprises:

g. still further extruding the billet through a third die aperture region so configured as to reduce the outer diameter of the tubular-shaped billet to an extent sufficient to weld said flat surfaces together along said flat, abutting relationship extending in said transverse direction.

8. A method as set forth in claim 7, further comprising:

h. initially providing a deoxidizing lubricant coating on the billet, prior to the performance of step (a).

9. A method as set forth in claim 7, wherein steps (a), (b), (c), (d), (e), (f) and (g) comprise:

h. extruding the billet along the longitudinal direction through a single die.

10. Apparatus for forming a metallic tube from an unpierced metallic billet, which apparatus comprises:

first means, operative upon displacement of the billet longitudinally therethrough, for so deforming the billet as to provide the billet with a generally C-shaped cross-section perpendicular to the longitudinal direction of displacement;

second means, operative upon displacement longitudinally therethrough of the deformed billet having said generally C-shaped cross-section, and having guiding surfaces disposed to engage both ends of the generally C-shaped cross-section and guide said ends continuously toward and then into contact with one another, for continuously reducing the diameter of said generally C-shaped cross-section while simultaneously further deforming the billet into a tubular shape;

third means, operative upon displacement longitudinally therethrough of the further deformed billet having said tubular shape, for welding said contacting ends together; and means for displacing the unpierced metallic billet in the longitudinal direction sequentially through said first, second and third means.

11. Apparatus as set forth in claim 10, wherein said first means further comprise:

means, operative upon the displacement of the billet longitudinally therethrough, for reducing the diameter of said generally C-shaped cross-section during said displacement.

12. Apparatus as set forth in claim 10, wherein said third means further comprise:

means, operative upon the displacement longitudinally therethrough of the further deformed billet having said tubular shape, for reducing the outer diameter of the tubular-shaped billet to an extent sufficient to cause the welding together of said contacting ends.

13. Apparatus as set forth in claim 12, wherein said first, second and third means each comprise means for defining corresponding first, second and third die aperture regions shaped to effectuate the function of each of said means.

14. Apparatus as set forth in claim 13, further comprising:

single die means including said first, second and third die aperture regions aligned along said longitudinal direction of displacement.

15. Apparatus as set forth in claim 14, wherein said displacing means comprise:

means, including a deoxidizing, lubricating, shear-transmitting medium, for applying to at least a portion of the longitudinally extending surface of the unpierced metallic billet, at least partially through said medium, a force in the direction of said single die means sufficient to displace the unpierced metallic billet through said single die means.

16. Apparatus as set forth in claim 14, wherein:

said first means further comprise means for so deforming the billet as to provide flat surfaces at both ends of the generally C-shaped cross-section, said flat surfaces being so oriented as to meet one another, upon the displacement of the deformed billet longitudinally through said second means, in a flat abutting relationship, extending along a direction transverse to a plane extending diametrically through said tubular shape; and said guiding surfaces of the second means are so disposed as to guide said ends continuously toward and then into contact with one another with said flat surfaces meeting one another in said flat, abutting relationship extending in said transverse direction.

* * * * *

UNITED STATES PATENT OFFICE

CERTIFICATE OF CORRECTION

Patent No. 4,037,454 Dated July 26, 1977

Inventor(s) FRANCIS JOSEPH FUCHS, JR.

It is certified that error appears in the above-identified patent and that said Letters Patent are hereby corrected as shown below:

In the specification, Column 1, line 22, "form tubing form tubing" should read --form tubing--. Column 2, line 51, "dies" should read --die--; Column 2, line 65, "extend" should read --extent--. Column 4, line 41, "due" should read --die--; Column 4, line 57, "16 is" should read --16--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*